United States Patent [19]

Giroux

[11] Patent Number: 4,595,373

[45] Date of Patent: Jun. 17, 1986

[54] PADDLE HOLDER

[76] Inventor: Piérre Giroux, 1515 Papineau Street, Trois-Rivières, Quebec, Canada, G8Z 4H7

[21] Appl. No.: 671,118

[22] Filed: Nov. 13, 1984

[51] Int. Cl.[4] ..... B63H 16/06

[52] U.S. Cl. ..... 440/104; 114/126; 114/364

[58] Field of Search ..... 114/122, 126, 140, 152, 114/364, 279.1; 440/6, 62, 63, 56, 900, 104, 106–108; 248/640–641

[56] References Cited

U.S. PATENT DOCUMENTS

| | | | |
|---|---|---|---|
| 2,509,974 | 5/1950 | Jacobs | 114/126 |
| 3,601,344 | 8/1971 | Nourse | 248/641 |
| 4,382,574 | 5/1983 | Ellested | 440/900 |

FOREIGN PATENT DOCUMENTS

| | | | |
|---|---|---|---|
| 1392346 | 2/1965 | France | 114/126 |
| 619232 | 3/1961 | Italy | 114/279 |

*Primary Examiner*—Trygve M. Blix
*Assistant Examiner*—Jesûs D. Sotelo

[57] ABSTRACT

A device to hold a canoe paddle in vertical position at either end of a canoe and having its blade submerged to serve as a keel to stabilize the otherwise tipsy craft and to greatly facilitate maneuverability by maintaining direction specially under windy conditions. The holder includes a bridge-like support bracket supporting an axially-rotatable transverse shaft extending outwardly over one side of the canoe. The outer end of the shaft carries a clamp to hold the upper shaft portion of the paddle. A resilient rotation stop is provided with the support bracket, so that the paddle blade rotatably yields when it strikes an under-water obstacle. Also, the paddle may be releasably locked in a non-use position parallel to the canoe gunwale.

9 Claims, 12 Drawing Figures

1
2
3"
3'
4
5
6

1
2'
3"
3'
6
2'

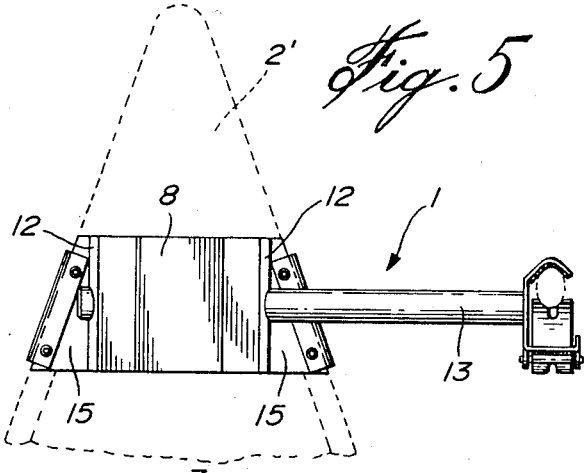
Fig. 5
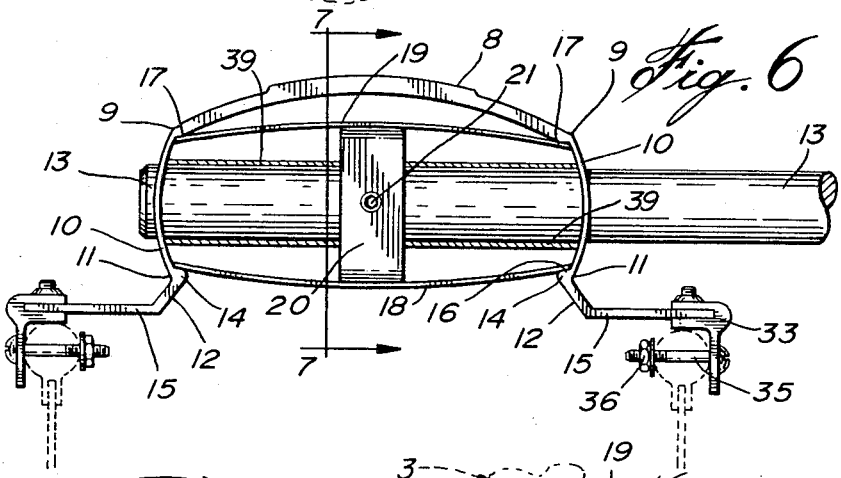
Fig. 6
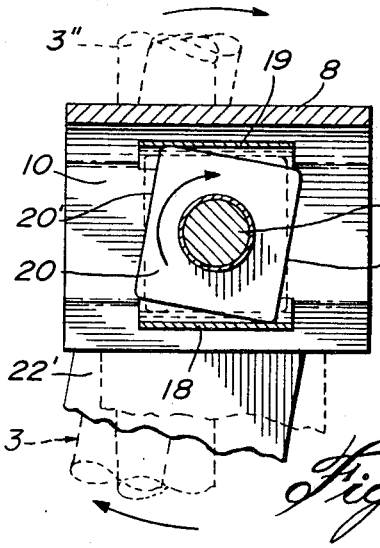
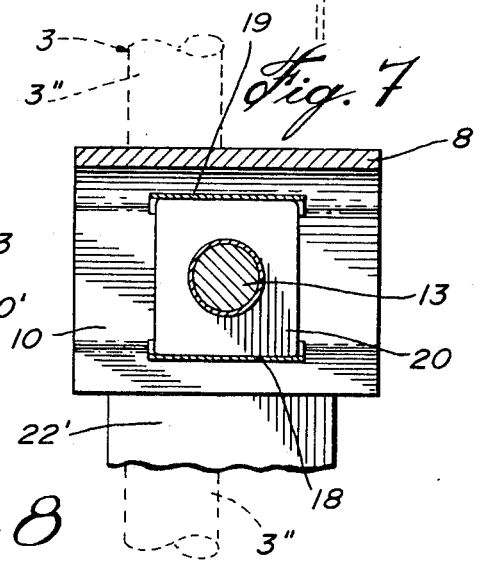
Fig. 7
Fig. 8

PADDLE HOLDER

FIELD OF THE INVENTION

The present invention relates generally to oarlocks for small water craft, more specifically to a device adapted to yieldably hold a canoe paddle in vertical stabilizing position specially when a canoeist is alone in the canoe.

BACKGROUND OF THE INVENTION

When at least two people are in a canoe, for example one person paddling in the bow and a helmsman paddling at the rear, it is easy to steer the canoe. However, when only one person is using the canoe, maneuvering is then more of a problem. Till now, as is known by canoeists, the maneuvering of a canoe on water by a single person is best performed by positioning the latter at mid-length of the canoe. The canoeist kneels on the bottom surface of the canoe, sits on his/her heels, about the inner side wall of the canoe, so that the canoe be inclined about 30 degrees sideways relative to its longitudinal axis. This position ensures the best possible control of the canoe, but has some disadvantages:

1. the keel, if any, tends to be slightly out of the water, which reduces its directional effectiveness and, thus, the straightforwardness of the path of the canoe;
2. the canoe is more sensitive to air drafts, because of the increased surface thereof being exposed out of the water;
3. the above canoeing position is more tiring for the canoeist;
4. the strenuous Delta stroke that must be used in this position requires an experienced canoeist, and remains a less efficient stroke than the known J-stroke used astern, wherein with the Delta stroke, a zigzaging path results; and
5. this is a very unstable position, which only an expert canoeist would feel comfortable with for any length of time.

The most comfortable position for an unexperienced single canoeist is to sit on the bench astern, where the canoeist may propel the canoe by effecting the simple J-stroke. However, it is almost impossible to control the canoe when a helmsman is absent from the bow in side wind conditions; and this control is still more difficult with white water canoes, since they lack a keel.

It is believed that there would be a large demand for an improvement in the field directed to canoeists operating alone a canoe.

OBJECTS OF THE INVENTION

Accordingly, it is an important object of the present invention to provide a paddle holder at one end of the canoe which rigidly supports a paddle substantially vertically with the blade being in the water to facilitate maneuvering.

Another object of the invention is to provide a paddle holder, the use of which with a paddle greatly increases safety by stabilizing the craft.

It is another object of the present invention to provide a paddle holder of the above type, wherein the paddle can be rotated about a transverse axis to yield against an underwater obstacle or to be stored substantially parallel to the gunwale of the canoe.

It is still another object of the present invention to provide a paddle holder of the above type, which is simple in design and attachable to any canoe make.

SUMMARY OF THE INVENTION

The above and other objects and advantages of the present invention are realized according to a preferred embodiment comprising a support bracket having lateral attachment means by which it can be attached, preferably detachably so, to one end of any standard canoe. The support bracket is adapted to support a rigid transverse shaft having one end portion extending horizontally outwardly. The outer end of the shaft carries a clamp means to which can be detachably secured the handle of a canoe paddle, the blade of the latter being held in generally vertical operative position and submerged.

Within the scope of the invention, the shaft is mounted for rotation about its axis, so that the clamp means, and hence the paddle, can be swung from its operative position through a quarter-circle to a storage position wherein the paddle extends parallel to the gunwale of the canoe. Resilient indexing means are further provided inside the bracket to act on the shaft, so as to yieldingly retain the shaft in either one of two rotated positions about 90° apart. This also allows the paddle blade to rotatably yield and then come back to its generally vertical position when any obstacle impinges on the submerged blade portion of the paddle.

BRIEF DESCRIPTION OF THE DRAWINGS

The above will be more clearly understood by having referral to the preferred embodiment of the invention, illustrated by way of the accompanying drawings, in which:

FIG. 5 is a top plan view of the invention according to the embodiment of FIG. 2, also showing in dashed outline the bow portion of a canoe and a paddle shaft in the clamp means;

FIG. 6 is a rear end elevation view of the support bracket and the attachment means of FIG. 3, also showing in dashed outline the gunwales of a canoe;

FIG. 7 is a cross-sectional view taken along lines 7—7 of FIG. 6;

FIG. 8 is a view similar to that of FIG. 7 but showing how the rotation stop means yields;

Like reference characters indicate like elements throughout the drawings.

DETAILED DESCRIPTION OF THE PREFERRED EMBODIMENTS

Figures 1, 2:
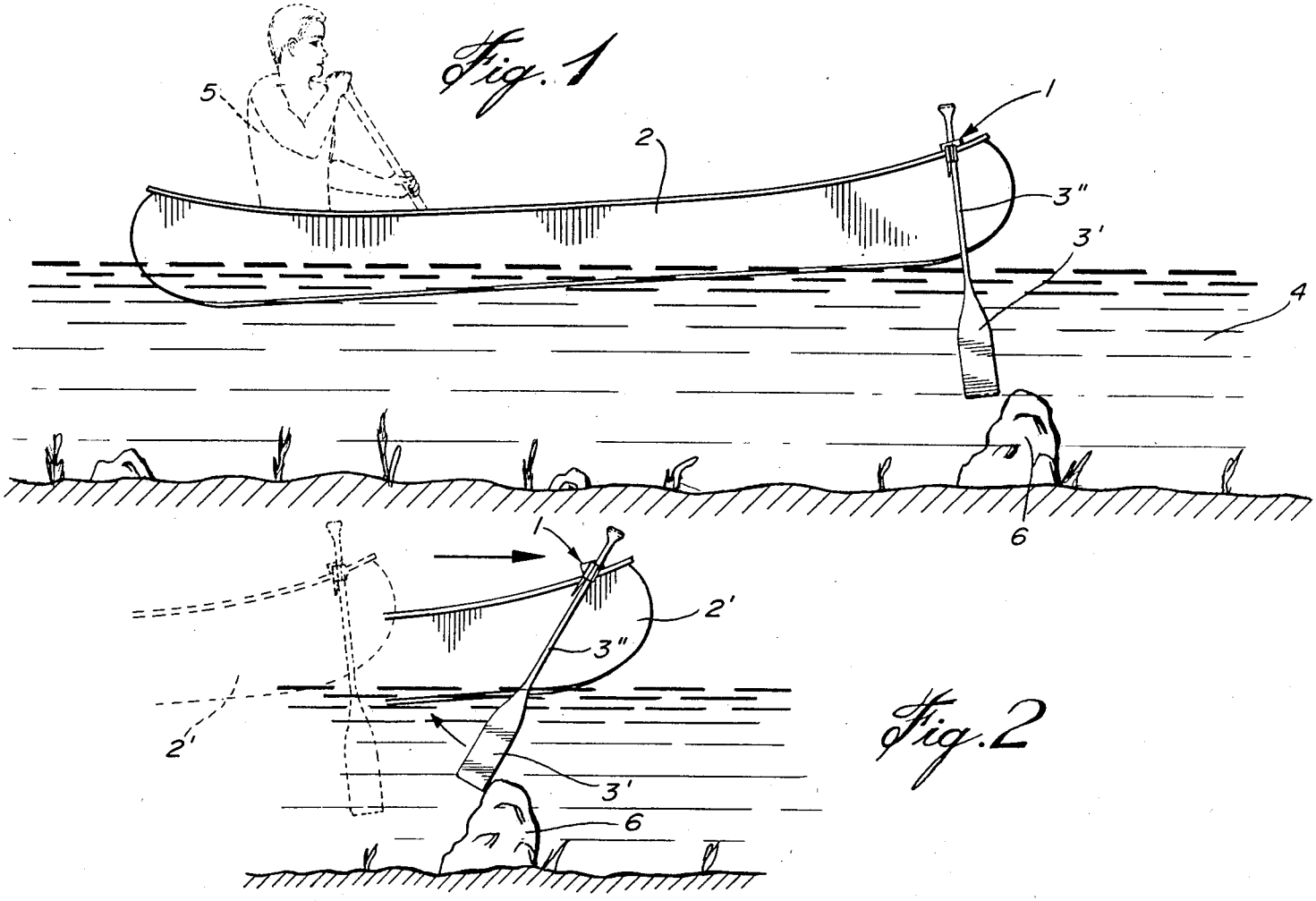
FIG. 1 is a side elevation of a canoe afloat and provided with the invention, to which is secured a paddle in canoe direction stabilizing position.
FIG. 2 is a partial side elevation of the canoe in a first position in dotted lines and in a second advanced position in full lines and showing how the paddle blade can yield to a submerged stone.

FIG. 1 illustrates the paddle holder 1 installed at the bow portion 2' of a standard canoe 2 and clasping the handle 3" of a paddle 3, the blade 3' of which is submerged in water 4 and is generally parallel to the canoe direction of travel. A helmsman 5 is shown seated astern of canoe 2.

Paddle 3 therefore acts as a direction stabilizer, so that helsman 5 can paddle alone in the canoe and will maintain the intended canoe direction even under a strong side wind. Yet steering can still be effected but with a greater steering radius.

As stated above, the paddle holder 1 is adapted to allow paddle 3 to rotatably yield and come back to its generally vertical position if any part of the submerged portion of the paddle strikes an underwater obstacle, such as a stone 6 (cf. FIG. 2).

Referring now to FIGS. 3 and 5 to 8, the paddle holder includes, firstly, a support bracket indicated generally at 7. Bracket 7 is of rigid material, having the general form of a bridge long enough to span the end portion 2' of canoe 2. Thus, bracket 7 includes a top portion 8, preferably slightly thicker in its central area, and slightly downwardly concave. Both lateral edges 9 of top portion 8 merge into outwardly-bulging perpendicular side wall 10, in turn having a lower edge 11 merging with an angularly-outwardly-projecting flat portion 12. Finally, the latter merges at its outer edge with a flat triangular horizontal flange 15 which is adapted to receive the attachment means.

Both side walls 10 are formed with a central hole through which rotatably extends a rigid transverse shaft 13. As illustrated, shaft 13 projects transversely outwardly from the right side of bracket 7, although, clearly, it could also be made to project out of the left side.

Shown specifically in FIG. 6, the interior construction of bracket 7 includes a first lower laterally-extending protuberance 14 at the inside surface of each lower edge 11 forming a first lower shoulder 16; and a second upper laterally-extending shoulder 17 formed by the greater thickness of top portion 8 relative to side walls 10 at edges 9.

First shoulder 16 is adapted to hold the end edges of a lower leaf spring 18. Similarly, second or upper shoulder 17 holds the end edges of an upper leaf spring 19.

The portion of rod 13 extending inside bracket 7 between side walls 10 is provided with a central block member 20, which is of square configuration in an axial perspective. A setscrew 21 or other means holds block 20 rigidly in place around rod 13. As clearly shown in FIG. 6, block 20 is of sufficient dimensions to deflect leaf springs 18,19 slightly away from shaft 13. Block member 20 and leaf springs 18, 19 constitute the above-mentioned resilient indexing means.

Referring to FIGS. 3, 5, and 9 to 12, there is depicted the clamp means for a paddle 3. The clamp means comprises a clamp bracket 22 formed of an inner wall 22', a rear windowed wall 22" having window 22*a* and an angular front wall 22"' having a forwardly-facing apex 23 which is rounded. Walls 22" and 22"' are transverse to inner wall 22'. The outer side of bracket 22 is open, thereby defining a large space through which the handle 3" of paddle 3 may be inserted into bracket 22. Preferably, the inner surface of front wall 22"' is provided with suitable padding 24 to prevent the handle 3' from being marred, and to insure only a three-point contact with the paddle.

The outer end of shaft 13 is rigidly secured to the inner wall 22' of bracket 22.

The clamp means further comprises a releasable cam member 25 which is transversely pivotable about a rod 26. The latter is journalled at either end in a pair of rearwardly-extending flanges 27 secured to inner wall 22'. Cam 25 is provided with a rigid tab 28 by which it may be manually moved to occupy a first downward release position and a second upper locking position, such that the cam surface 25' presses against the handle 3" of paddle 3.

Cam 25 also includes a biasing means to maintain it in upper position. This biasing means consists of: a vertically-depending rod 29 having a bent lower end 29'; a coil tension spring 30 having one end attached to lower end 29' and its opposite end attached to a pin 31 extending through cam 25. The central portion of the latter is formed with a cross-sectionally semi-circular groove 32 which extends from roughly the mid-point of the cam surface 25' to the mid-point of the rear surface of the cam 25, where it curves upwardly rearwardly, then frontwardly to merge with the tab 28. Spring 30 extends in groove 32.

Figure 10:
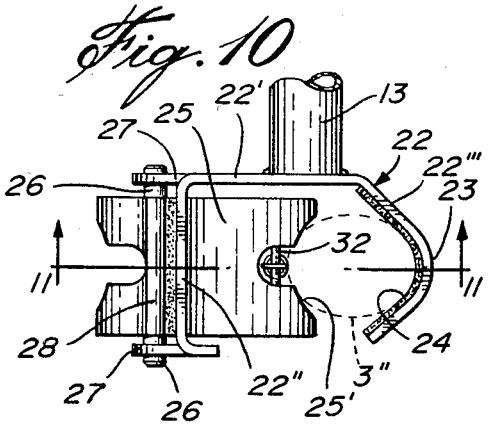
FIG. 10 is a top plan view of the clamp means and also showing in dashed outline the paddle handle therein.
Figure 12:
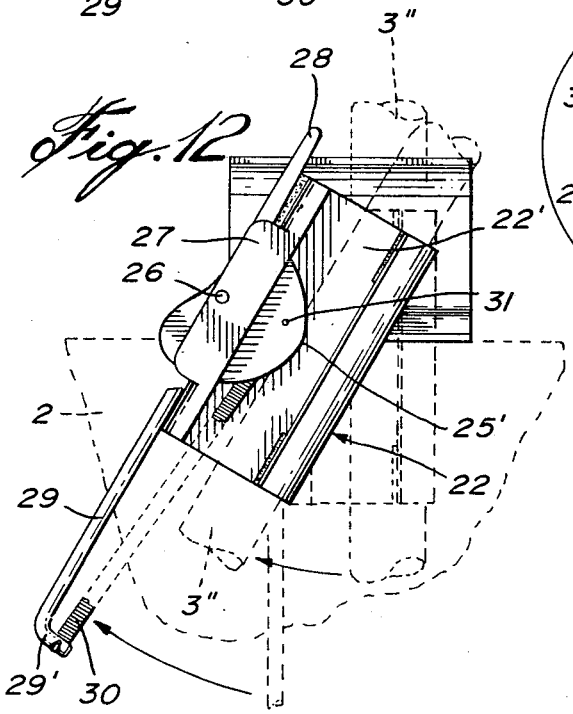
FIG. 12 is a view similar to that of FIG. 9, showing the clamp means in tilted position relative to the support bracket, also showing in dashed outline the side of the canoe and the shaft of the paddle.
Figure 11:
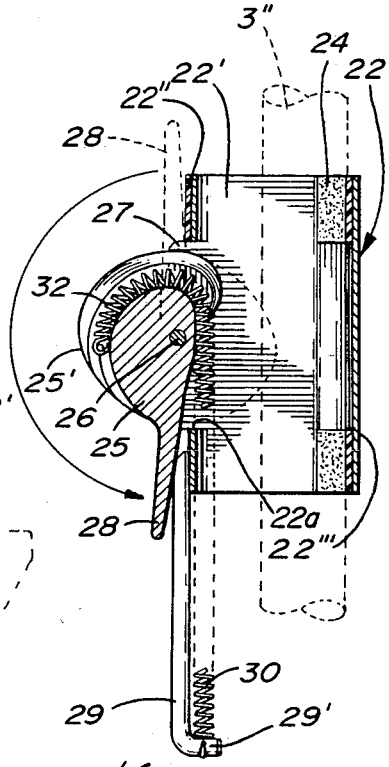
FIG. 11 is a cross-sectional view taken along lines 11—11 of FIG. 10.

FIG. 10 clearly indicates that cam surface 25' is concavely recessed along a major part of its length to precisely hold the handle 3" in cooperation with front wall 22"'.

Figure 3:
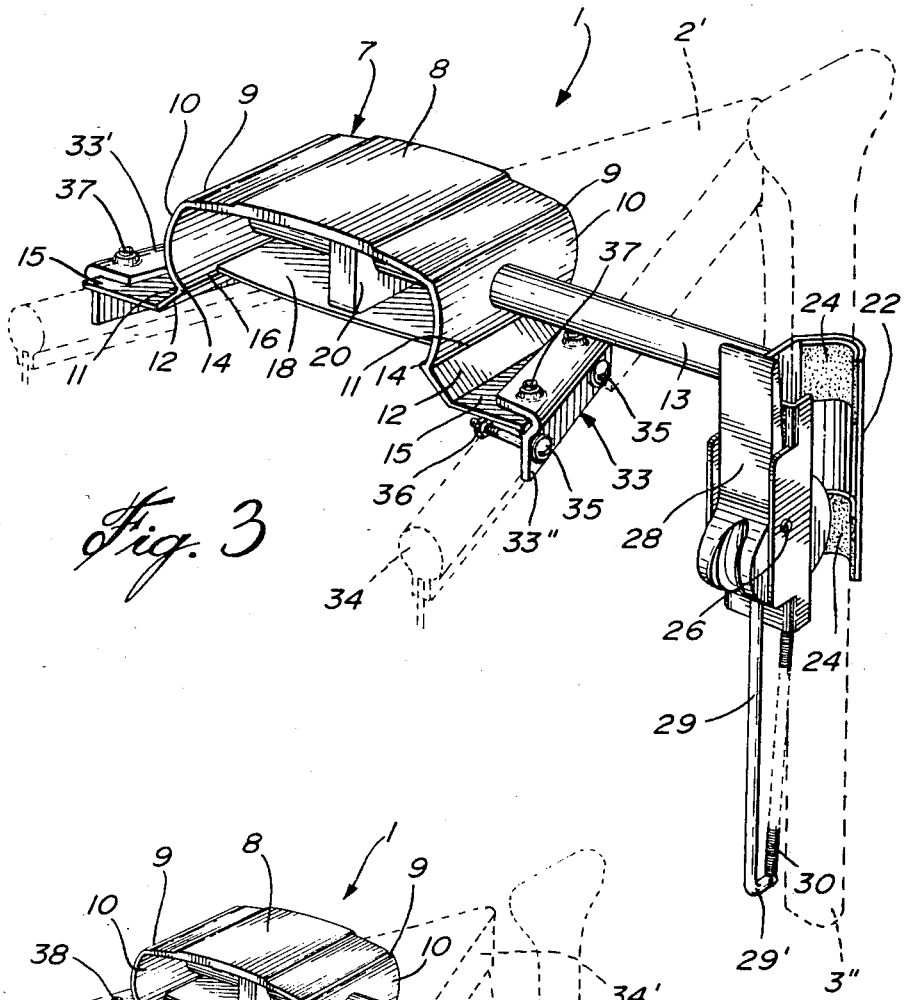
FIG. 3 is a perspective view of the invention, also showing in dashed outline the bow of a canoe and paddle.
Figure 4:
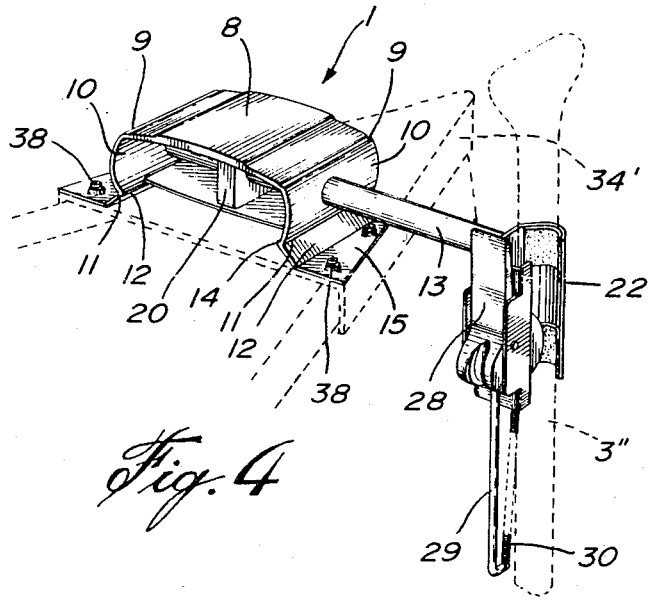
FIG. 4 is a view similar to that of FIG. 3 showing an alternate embodiment of the attachment means for the support bracket.
Figure 9:
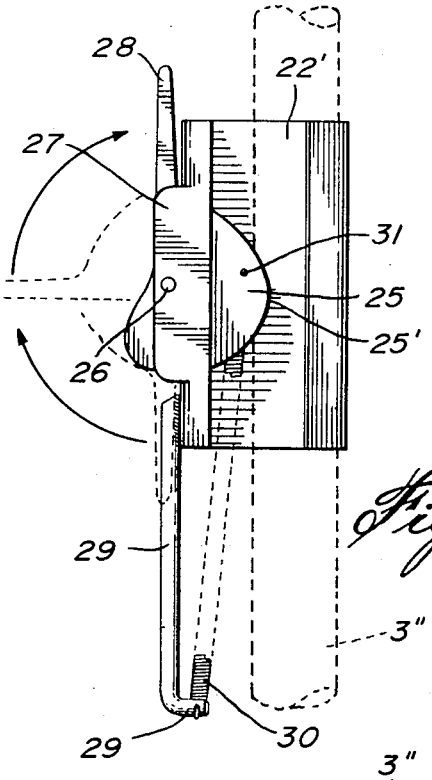
FIG. 9 is a lateral elevation of the clamp means, also showing in dashed outline a canoe paddle upper portion.

Referring now to FIGS. 3 and 4, there is shown the attachment means for support bracket 7. The means is simple, consisting of a cross-sectionally L-shaped fastening member 33 provided with a longitudinal slot in its horizontal flange 33' adapted to receive the outer edge of each triangular flange 15, the latter held in place by screws 37. The vertical flange 33" of member 33 projects downwardly exteriorly of gunwale 34 of the canoe and is fastened thereto by screws 35 and nuts 36. FIG. 4 illustrates the alternate embodiment of the attachment means wherein flange 15 is directly fastened to a modified gunwale 34' by screws 38.

FIG. 1 illustrates canoe 2 moving towards an underwater obstacle, such as a stone 6. As the blade 3' strikes stone 6 (in FIG. 2), bracket 22 will begin to rotate bodily with shaft 13. As seen in FIG. 8, the rotation of shaft 13 causes block 20 to rotate against the retaining bias of leaf springs 18 and 19 until the canoe paddle 3 gives way enough to pass over stone 6. The resilient nature of leaf springs 18 and 19 will then force shaft 13 and hence bracket 22 into its original position, so that paddle 3 once again assumes a vertical orientation in the water, provided, of course, that the paddle will have rotated through less than about 40° to clear the obstacle.

Alternatively, the rotation stop means described will allow the paddle 3 to be rotated manually through a quarter-circle to assume a storage position parallel to the gunwales 34 or 34'. In this case, block 20 will have its originally free faces 20' moved into resilient contact with leaf springs 18 and 19.

Normally, leaf springs 18, 19 should keep block 20 centered relative to bracket 7 in order to prevent axial movement of shaft 13 in bracket 7. However, if such is found insufficient, removable rigid sleeves 39 can surround shaft 13 on each side of block 20 and each spanning the distance between the block 20 and side wall 10, as shown in section in FIG. 6. By unscrewing setscrew 21, shaft 13 can be removed from bracket 7 and reinserted into the opposite side of said bracket.

What I claim is:

1. A paddle holder for use with a conventional canoe, comprising a support bracket adapted to be attached to one end of said canoe, said support bracket having the general form of a bridge long enough to span transversely of said end of said canoe and including a top portion; a pair of side walls merging with said top portion; each said side wall in turn merging at its lower edge with an outwardly-projecting flange; each said flange being adapted to rest on and be secured to said end of said canoe; a rigid, transverse horizontal shaft having one end portion journalled in said side walls for rotation in said support bracket and having its opposite end portion projecting outwardly away from one side of said canoe when said support bracket is attached to said end of said canoe; a paddle handle clamp means rigidly secured to said opposite end portion of said horizontal shaft and adapted to securely, releasably grip the handle of a canoe paddle, and resilient shaft indexing means, whereby said canoe paddle is yieldably held in an operative position with its blade being submerged and will rotatably yield and come back to its operative position if said blade encounters a submerged obstacle.

2. A paddle holder as defined in claim 1, wherein said resilient shaft-indexing means yieldably hold said shaft in either one of two rotated positions 90° apart, whereby the paddle can be yieldably retained by said shaft in an operative generally vertical position, with the paddle blade submerged and a generally horizontal position with the paddle blade out of the water.

3. A paddle holder as defined in claim 1, wherein said bridge has a pair of axially-aligned holes made in said side walls; said one end portion of said horizontal shaft extending through said holes under said top portion; said resilient shaft indexing means including a pair of first lower shoulders formed at the inner surface of said side walls adjacent the lower edge thereof; a pair of second upper shoulders each formed at the inner surface of each said side wall adjacent said top portion; lower and upper leaf springs extending transversely within the bracket and having their lateral edges abutting against said first and second pairs of shoulders, respectively; said leaf springs extending below and above said horizontal shaft; respectively, and longitudinally of the latter; and a block member secured around said horizontal shaft and centrally of said bridge; said block member having a square configuration in an axial perspective; said block member having two opposed sides engaging said lower leaf spring and said upper leaf spring respectively, said block member of sufficient dimension to deflect said lower and upper leaf springs slightly away from said rod.

4. A paddle holder as defined in 1, wherein said clamp means comprises: a clamp bracket formed of an inner wall, a rear windowed wall and an angular front wall, both transverse to said inner wall, the outer side of said clamp bracket being open; the outer end of said horizontal shaft being rigidly fixed to said inner wall; further comprising a pair of transversely-spaced flanges projecting rearwardly from said rear windowed wall; a cam member mounted on a transverse pivot journalled in said flanges and extending through the window of said rear windowed wall; said cam member having a working curve portion and a rigid tab and being arranged to pivot between a first release position and a second locking position, wherein the cam working curve portion presses against the handle of said canoe paddle held in said clamp bracket; said cam working curve portion being concavely recessed along a major part of its length.

5. A paddle holder as defined in claim 4, wherein said cam member is provided with a biasing means to bias it in said second locking position.

6. A paddle holder as defined in claim 5, wherein said biasing means consists of a depending elongated member secured at its inner end to the middle of said rear wall and having a free lower end; a cross-sectionally semi-circular groove formed in said cam member along its working curve portion; a tension spring having one end secured to said free lower end of said elongated member, and its opposite end secured to a pin extending transversely through said cam member; said spring extending in said groove.

7. A paddle holder as defined in claim 1, further including an L-shape fastening member having a horizontal flange and a vertical flange; said horizontal flange being formed with a longitudinal slot adapted to receive the outer edge of each said flange, and having fasteners extending through the latter; said vertical flange adapted to project downwardly exteriorly of the gunwale of said canoe and be secured thereto by other fasteners.

8. A paddle holder for use with a conventional canoe having a pointed end portion, comprising a support bracket adapted to be attached to the top of said pointed end portion, attachment means so to attach said support bracket to said pointed end portion; a rigid, transverse shaft having one end portion rotatably mounted in said support bracket and having its opposite end portion projecting outwardly away from one side of said canoe with said shaft extending across said canoe and over said top when said support bracket is attached to said pointed end portion; a paddle handle clamp means rigidly secured to said opposite end portion of said shaft and securely releasably gripping the handle of a canoe paddle, with said handle held by said clamp means normal to said horizontal shaft and close to the longitudinal axis of said canoe, and resilient shaft-indexing means carried by said bracket, yieldably retaining said shaft in either one of two rotated positions at about 90° apart, whereby said canoe paddle is yieldably held in operative generally vertical position with its blade being submerged and will rotatably yield and come back to its operative position if said blade encounters a submerged obstacle, and can be manually swung to a storage position with said paddle held in a generally horizontal position.

9. A paddle holder as defined in claim 8, wherein said support bracket has the general form of a bridge long enough to span transversely of said end portion of said canoe and including a top portion; a pair of side walls merging with said top portion; each said side wall in turn merging at its lower edge with an outwardly projecting flange; each said flange being adapted to rest on and be secured to said end portion of said canoe, said shaft journalled in said side walls.

* * * * *